US005088831A

United States Patent [19]

Reinhall

[11] Patent Number: 5,088,831

[45] Date of Patent: Feb. 18, 1992

[54] DEVICE FOR TREATING MATERIAL MIXTURES

[75] Inventor: Rolf B. Reinhall, Bellevue, Wash.

[73] Assignee: Sunds Defibrator Industries Aktiebolag, Sweden

[21] Appl. No.: 536,666

[22] PCT Filed: Jan. 11, 1988

[86] PCT No.: PCT/SE89/00003

§ 371 Date: Jul. 6, 1990

§ 102(e) Date: Jul. 6, 1990

[87] PCT Pub. No.: WO89/07486

PCT Pub. Date: Aug. 24, 1989

[30] Foreign Application Priority Data

Feb. 9, 1988 [SE] Sweden ..... 8800416-3

[51] Int. Cl.[5] ..... B01F 7/02; B01F 15/00

[52] U.S. Cl. ..... 366/171; 366/279; 366/286; 366/305

[58] Field of Search ..... 366/285, 286, 293, 294, 366/296, 302, 305, 306, 331, 99, 171, 279, 307; 241/166, 167, 259.1, 205

[56] References Cited

U.S. PATENT DOCUMENTS

| | | | |
|---|---|---|---|
| 712,051 | 10/1902 | Elliott | 241/167 X |
| 823,109 | 6/1906 | Crocker | 241/259.1 |
| 1,674,231 | 6/1928 | Thomas | 241/259.1 X |
| 1,681,935 | 8/1928 | Harrigan | 241/259.1 |
| 1,873,199 | 8/1932 | Haskell | 241/259.1 |
| 2,081,460 | 5/1937 | Lorentz | 241/167 |
| 2,169,339 | 8/1939 | Ditto | 366/305 |
| 2,314,993 | 3/1943 | Langrish | 241/167 |
| 2,403,914 | 7/1946 | Eppenbach et al. | 241/259.1 X |
| 2,591,966 | 4/1952 | Rider | 366/305 X |
| 2,960,318 | 11/1960 | Caillaud | 366/305 X |
| 2,971,704 | 2/1961 | Johansson | 241/259.1 X |
| 4,416,548 | 11/1983 | Carre et al. | 366/305 X |

*Primary Examiner*—Philip R. Coe

*Attorney, Agent, or Firm*—Lerner, David, Littenberg, Krumholz & Mentlik

[57] ABSTRACT

Apparatus for treating material mixtures such as fiber mixtures is disclosed, including conically shaped corresponding inner and outer members defining a gap between their treating surfaces and being relatively rotatable with respect to each other, with at least one of the inner and outer treating surfaces including longitudinally extending grooves, and cleaning wings for cleaning the grooves protecting into the grooves and being movable along the grooves in order to do so.

11 Claims, 1 Drawing Sheet

A
B
10
11
12
13
14
15
16
17
18
20
22
30
32-30
32
34
36
40
42
44
50
60
62
64
66
67
68
70
80
81
82
83
84
85
86
90
92

DEVICE FOR TREATING MATERIAL MIXTURES

FIELD OF THE INVENTION

The present invention relates to a device for treating material mixtures. More particularly, the present invention relates to apparatus for treating material mixtures which includes a pair of conically shaped inner and outer treating members which are relatively rotatable with respect to each other.

BACKGROUND OF THE INVENTION

The use of a pair of inner and outer treating members, preferably conical, and which are rotatable relative to each other, is known. By utilizing these types of treating members, different materials can be mechanically processed, dispersed and/or mixed. For example, organic or inorganic fibers or particles can be dispersed in gaseous or fluid media, such as air, steam, water, etc. Also, chemicals such as colorants, bleaching agents, binding agents, etc., can be admixed therein. Conventional mixing members of this type have a number of variants, including rotating and counter-rotating disk-shaped or conically shaped rotation bodies, which are provided with treating surfaces showing different patterns of recessed and elevated portions, which produce the turbulence and agitation required to perform their intended function.

When certain chemicals, such as binding agents, are added to fiber mixtures, difficulties normally arise due to coatings being applied and/or clogging of these grooved patterns of the treating surface. Furthermore, these coatings and such clogging are difficult to remove, and after a certain period of operation they can prevent the proper functioning of the mixer. In that case, the mixer has to be taken out of operation for cleaning purposes, which, in turn, causes repeated stoppages, and thus results in production disturbances.

The only manner of overcoming these interruptions has been to install extra mixing devices, to which the fiber flow can thus be transferred during the time when the clogged machines are being cleaned and restored to their operational state. This procedure is expensive, both in terms of manual service and the extra investments required therefor.

SUMMARY OF THE INVENTION

In accordance with the present invention, these and other difficulties have now been overcome by the invention of apparatus for the treatment of material mixtures which comprises an inner treating member having an outer treating surface, and a corresponding outer treating member having an inner treating surface, and surrounding the inner treating member so as to provide a gap therebetween, such that the material mixture can be fed through the gap for treatment between the inner and outer treating surfaces, the inner and outer treating members being relatively rotatable with respect to each other, at least one of the inner and outer treating surfaces including a plurality of longitudinally extending grooves, and cleaning means for cleaning the plurality of longitudinally extending grooves, the cleaning means comprising projection means extending into the longitudinally extending grooves and being movable along the longitudinally extending grooves so as to clean the material mixture therefrom. In a preferred embodiment, the inner and outer treating surfaces are both conically shaped.

In accordance with a preferred embodiment of the apparatus of the present invention, at least one of the inner and outer treating surfaces includes a plurality of longitudinally extending bars defining the plurality of longitudinally extending grooves, such that the cleaning means are provided between the plurality of longitudinally extending bars.

In accordance with one embodiment of the apparatus of the present invention, the at least one of the inner and outer treating surfaces comprises the inner treating surfaces. In a preferred embodiment, both the inner and outer treating surfaces include a plurality of longitudinally extending grooves, and the cleaning means comprise first cleaning means including first projection means extending into the longitudinally extending grooves in the inner treating surface, and being movable along the longitudinally extending grooves in the inner treating surface so as to clean the material mixture therefrom, and including second cleaning means comprising second projection means extending into the longitudinally extending grooves in the outer treating surface and being movable along the longitudinally extending grooves in the outer treating surface so as to clean the material mixture therefrom.

In accordance with another embodiment of the apparatus of the present invention, the conically shaped inner member comprises a rotor and the corresponding conically shaped outer member comprises a stator.

In another embodiment, the cleaning means includes ring pistons for supporting the cleaning means, and cleaning means moving means for moving the cleaning means along the longitudinally extending grooves, the cleaning means moving means including a pressure medium.

In accordance with another embodiment of the apparatus of the present invention, the conically shaped inner member includes a first narrow end and a second wide end, and including means for feeding the material mixture to the narrow end of the conically shaped inner member.

In a preferred embodiment, the conically shaped inner member includes carrier means located at the first narrow end of the conically shaped inner member for accelerating the material mixture towards the gap between the inner and outer treating surfaces. Preferably treating agent supply means are also included for supplying a treating agent to the material mixture, the treating agent supply means being located adjacent to the feed means.

In another embodiment, the treating means supply means is located in the conically shaped outer member and comprises nozzle means for injecting the treating agent in a position adjacent to the first narrow end of the conically shaped inner member.

On an overall basis, the present invention thus eliminates these problems by providing mechanical cleaning members which during operation of the mixer either continuously or intermittently remove material accumulated thereon, and thus maintain the efficiency of the mixture at a maximum level.

The principles of the present invention can be applied to disk-shaped as well as conically shaped treating planes.

BRIEF DESCRIPTION OF THE DRAWINGS

The present invention can be more fully understood with reference to the following drawings, in which.

DETAILED DESCRIPTION

Figures 1, 2, 3:
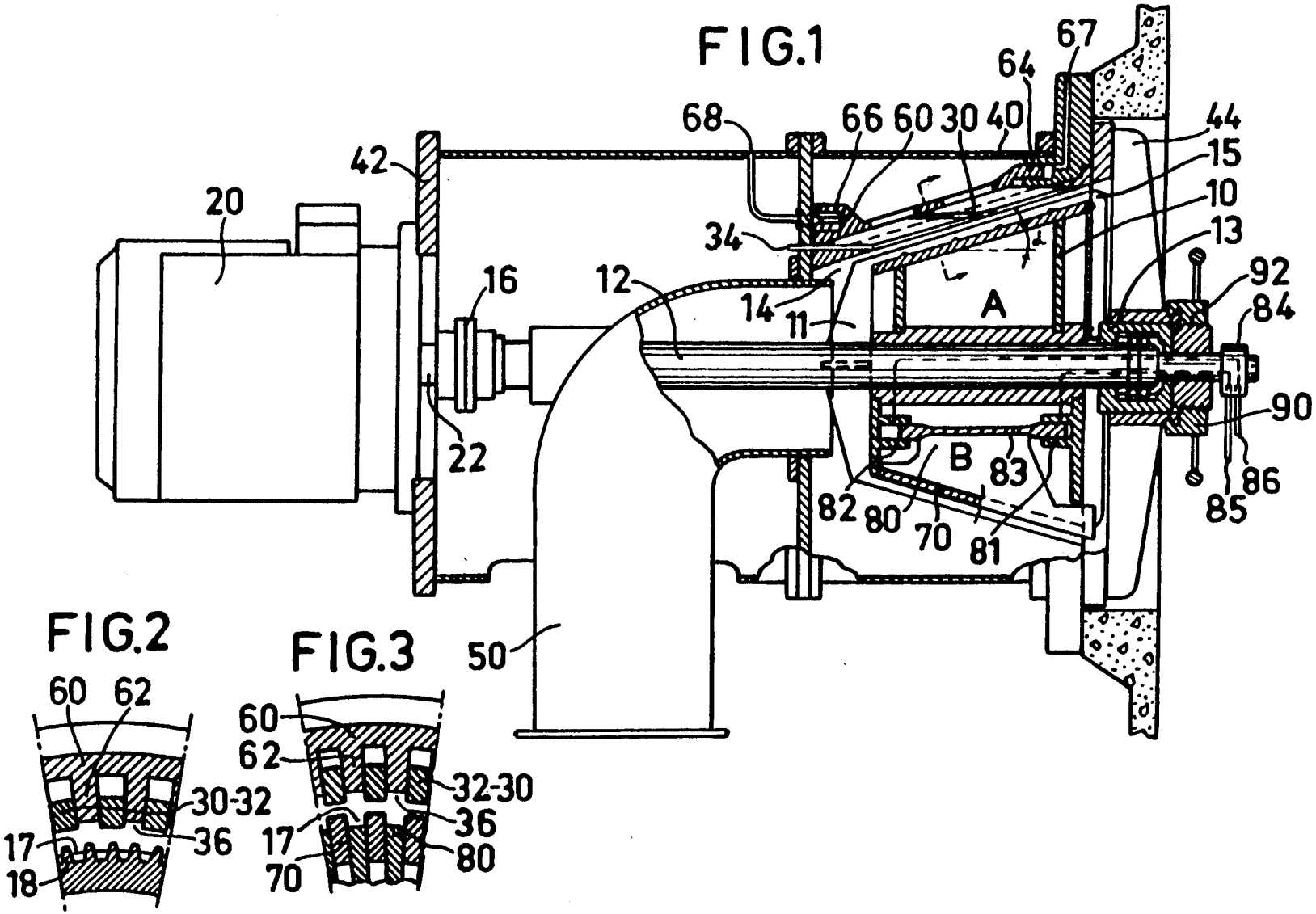
FIG. 1 is a side, elevational, partially sectional view of an apparatus in accordance with the present invention showing two embodiments (A and B)
FIG. 2 is an end, sectional view of the inner and outer treatment surfaces and cleaning members of one embodiment of the present invention.
FIG. 3 is an end, sectional view of the inner and outer cleaning members in accordance with another embodiment of the present invention.

Referring to the Figures, in which like numerals refer to like portions thereof, the apparatus shown therein includes a rotor 10 supported by an axle 12 which is mounted in an axially movable bearing housing 13, and which is supported at the driving end by an axially movable gear clutch 16. The gear clutch 16 is, in turn, rigidly connected to a driving motor 20 by means of a shaft 22.

The rotor 10 is surrounded by a stator 30, which includes longitudinal bars 32 and intermediate grooves 36, and which is rigidly secured to a stand 40 which encloses the device. An upper portion of stand 40 supports the driving motor 20. The bearing housing 13 is supported by a yoke bearing 44 which is connected to the lower portion of stand 40.

Rotor 10 is axially movable by means of a control device 90, which is attached to the yoke bearing 44. This control device 90 can thus adjust the bearing housing 13 to its desired axial position, and thus vary the gap between the rotor 10 and the stator 30.

The material to be treated, such as fibrous material, is supplied through pipe line 50, which opens into the smaller or narrower end of the conical rotor 10. In this manner, by means of a carrier 11 which is mounted on the rotor 10, the material is projected outward to inlet opening 14 between rotor 10 and stator 30.

By means of bars 18 (see FIG. 2) or bars 70 (see FIG. 3) on the rotor 2, the fiber material is caused to assume the rotational speed, which is substantially the same as that of the rotor itself, and which is, for example, 3000 rpm at 50 cps and 3600 rpm at 60 cps. This rotation thus creates centrifugal forces upon the fiber material, which, in the case of this particular example, amount to a magnitude of 2500–4000 g, by which forces the fiber mixture is pressed against the enclosing stator 30 during its passage through the mixer.

In view of these rather high centrifugal forces, the fiber mixture is concentrated to a considerably higher density in that fiber layer which is closest to the stator 30, and, in particular, in the longitudinally extending grooves 36. Furthermore, the greatest proportion of the air which follows along with the fiber suspension passes through the grooves 17 of the rotor 10, and between the rotor bars 18, 70 to the outlet 15 of the mixer.

The concentrated fiber mixture closest to the conically shaped stator surface 30, having an angle $\alpha$, is applied with a discharging force in the direction towards the outlet 15 corresponding to the $\alpha$-sine component of the centrifugal force maintained therein.

Any chemical addition which is required in this process can be supplied either at the inlet 50 or directly between the rotor 10 and the stator 30 at a point adjacent to the feed opening 14 by means of a number of supply nozzles 34, which are preferably uniformly distributed over the inlet surface.

The chemical thus supplied, which can be either in a liquid or aerosol state, is thus instantaneously sprayed about the circumference of the rotor 10, and by the centrifugal force maintained therein is projected outwardly to the concentrated fiber layer of the stator, where it is absorbed during passage of the material through the mixer.

In order to prevent the stator grooves 36 from thus being filled with fibers, and possibly also added binding agent or the like, in the manner described above, the stator 30 is provided with an axially movable enclosing outer cleaning member 60, which is provided with wings 62 (see FIG. 1 and FIG. 2). These wings 62 are adapted to partially fill the grooves 36 between the rigidly secured stator bars 32. When this outer cleaning member 60 is moved axially in a direction towards the outlet 15 of the mixer, the inner flank of the wings 62 is moved radially inward to and past the inner surface of the rigidly secured stator bars 32, and in this manner the grooves 36 between the bars 32 are filled entirely with the movable wings 62. Fiber and binding agent deposits which have accumulated in the grooves 36 are thus pushed out to the gap between the rotor 10 and the stator 30, where by the action of the rotor bars 18 they are broken off from the wings 62 and removed along with the remainder of the treated material. The outer cleaning member 60, with wings 62, can then be moved back towards the inlet of the mixer, and the groove space 36 is thus restored, but now free from previous coating or clogging.

In this example, shown in the Figures, moveably cleaning member 60 is caused to carry out its reciprocatory movement by means of a pressure medium, which is alternately supplied to ring pistons 64 and 66, which support the cleaning member, through passageways 67 and 68.

The frequency of such cleaning movement can be adjusted to meet the demand for maintaining maximum mixing effect. If required, a corresponding cleaning device can be applied also to the rotor 10, in which case an axially movable inner cleaning member 80 can be attached to similar ring pistons 81 and 82, which, by means of the supply of a pressure medium through a swivel 84 mounted on the axle 12, and through passageways 85 and 86 in the axle, is caused to carry out a similar reciprocatory movement. The frequency of same in this case can also be adjusted to meet the demand therefor. This embodiment is shown in FIG. 1.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. Apparatus for the treatment of material mixtures comprising an inner treating member having an outer treating surface, a corresponding outer treating member having an inner treating surface and surrounding said inner treating member so as to provide a gap therebetween whereby said material mixture can be fed through said gap for treatment between said inner and outer treating surfaces, said inner and outer treating members being relatively rotatable with respect to each other, at least one of said inner and outer treating surfaces including a plurality of longitudinally extending grooves, and cleaning means for cleaning said plurality of longitudinally extending grooves, said cleaning means comprising projection means extending into said longitudinally extending grooves and being movable along said longitudinally extending grooves so as to clean said material mixture therefrom.

2. The apparatus of claim 1 wherein said inner treating member is conically shaped and said outer annular member is conically shaped.

3. The apparatus of claim 2 wherein said at least one of said inner and outer treating surfaces includes a plurality of longitudinally extending bars defining said plurality of longitudinally extending grooves, whereby said cleaning means are provided between said plurality of longitudinally extending bars.

4. The apparatus of claim 2 wherein said at least one of said inner and outer treating surfaces comprises said inner treating surface.

5. The apparatus of claim 2 wherein said conically shaped inner member comprises a rotor and said corresponding conically shaped outer member comprises a stator.

6. The apparatus of claim 2 wherein said cleaning means includes ring pistons for supporting said cleaning means, and cleaning means moving means for moving said cleaning means along said longitudinally extending grooves, said cleaning means moving means including a pressure medium.

7. The apparatus of claim 2 wherein said conically shaped inner member includes a first narrow end and a second wide end, and including means for feeding said material mixture to said narrow end of said conically shaped inner member.

8. The apparatus of claim 7 wherein said conically shaped inner member includes carrier means located at said first narrow end of said conically shaped inner member for accelerating said material mixture towards said gap between said inner and outer treating surfaces.

9. The apparatus of claim 8 including means for supplying a treating agent to said material mixture, said means being located adjacent to said feed means.

10. The apparatus of claim 8 including means located in said conically shaped outer member and comprising nozzle means for injecting said treating agent in a position adjacent to said first narrow end of said conically shaped inner member.

11. Apparatus for the treatment of material mixtures comprising an inner treating member having an outer treating surface, a corresponding outer treating member having an inner treating surface and surrounding said inner treating member so as to provide a gap therebetween whereby said material mixture can be fed through said gap for treatment between said inner and outer treating surfaces, said inner and outer treating members being relatively rotatable with respect to each other, said inner treating surface including a first plurality of longitudinally extending grooves, said outer treating surface including a second plurality of longitudinally extending grooves, first cleaning means for cleaning said first plurality of longitudinally extending grooves, said first cleaning means comprising first projection means extending into said first longitudinally extending grooves and being movable along said first longitudinally extending groove so as to clean said material mixture therefrom, and second cleaning means for cleaning said second plurality of longitudinally extending grooves, said second cleaning means comprising second projection means extending into said second longitudinally extending grooves and being movable along said second longitudinally extending grooves so as to clean said material mixture therefrom.

* * * * *

UNITED STATES PATENT AND TRADEMARK OFFICE

CERTIFICATE OF CORRECTION

PATENT NO. : 5,088,831

DATED : February 18, 1992

INVENTOR(S) : Rolf B. Reinhall

It is certified that error appears in the above-identified patent and that said Letters Patent is hereby corrected as shown below:

On the Title page, item[22] PCT Filed: delete "Jan. 11, 1988" and insert therefor --Jan. 11, 1989--.

Column 5, line 11 delete "annular" and insert therefor --treating--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*